US005915783A

United States Patent [19]

McDowell et al.

[11] Patent Number: 5,915,783

[45] Date of Patent: Jun. 29, 1999

[54] HEATED STADIUM SEAT

[75] Inventors: Keith McDowell, Belmont; Erich Bernhardt; Bernard Herold, III, both of Wyoming, all of Mich.

[73] Assignee: American Seating Company, Grand Rapids, Mich.

[21] Appl. No.: 09/072,478

[22] Filed: May 4, 1998

[51] Int. Cl.[6] ..... A47C 7/72

[52] U.S. Cl. ..... 297/180.12; 297/452.65; 219/217; 5/421

[58] Field of Search ..... 297/180.11, 180.12, 297/452.65, DIG. 2; 5/421, 656; 219/217, 202, 522

[56] References Cited

U.S. PATENT DOCUMENTS

| | | | |
|---|---|---|---|
| 2,698,893 | 1/1955 | Ballard . | |
| 2,961,524 | 11/1960 | Newman | 5/421 |
| 4,413,857 | 11/1983 | Hayashi | 297/180.11 X |
| 4,813,738 | 3/1989 | Ito | 5/421 |
| 4,865,379 | 9/1989 | Aoki et al. | 297/180.12 X |
| 5,067,771 | 11/1991 | Ellis | 297/180.11 |
| 5,516,189 | 5/1996 | Ligeras | 5/421 |

FOREIGN PATENT DOCUMENTS 2 229 328 9/1990 United Kingdom .

*Primary Examiner*—Peter M. Cuomo
*Assistant Examiner*—Anthony D. Barfield
*Attorney, Agent, or Firm*—Dickinson Wright PLLC

[57] ABSTRACT

A heated seat assembly especially suitable for outdoor use. A heater insert is positioned in the hollow of the seat cushion and includes a substrate member and a thin film heating element positioned on the substrate member. The heater insert is inserted into the hollow of the cushion through a slot in the rear edge of the cushion to position the thin film heating element within the hollow of the cushion beneath the seating surface. The heater insert is held in position by positioning of the forward edge of the substrate member in a crevice defined interiorly of the cushion proximate the front end of the cushion and by adhesive securement of a handle portion of the heater insert against an outer face of the rear edge of the cushion. Leads extend from terminals of the heating element to a plug in the handle portion of the insert which may be accessed by a plug of a pigtail cord extending from a junction box positioned on a riser surface of a grandstand immediately behind the seat assembly. Expanded foam is delivered into the hollow of the cushion beneath the substrate member to fill the area beneath the substrate member to discourage downward migration of heat generated by the heater insert and direct the generated heat upwardly to the seating surface. A similar heater insert is positioned in the seat back of the seat assembly and includes an exterior plug which may be connected by a further pigtail cord emanating from the junction box.

10 Claims, 5 Drawing Sheets

HEATED STADIUM SEAT

BACKGROUND OF THE INVENTION

This invention relates to heated seats and more particularly to heated seats for use in an outdoor environment such as a stadium.

Various proposals have been made for heated seat designs for use in an outdoor stadium environment. However, none of these proposals have seen any significant commercial exploitation since each design suffers from one or more disadvantages. Specifically, the design is too expensive to install initially; the design is too expensive to operate; or the design is not rugged and durable enough to withstand prolonged exposure to the temperature and precipitation extremes encountered in an outdoor stadium environment.

SUMMARY OF THE INVENTION

This inventions is directed to the provision of an improved heated seat.

More specifically, this invention is directed to the provision of a heated seat that is especially suitable for use in an outdoor environment such as a stadium.

The heated seat of the invention is of the type including a seat cushion and a seat back. According to one feature of the invention, the seat cushion is hollow and defines a generally horizontally extending seating surface; a substrate member is positioned within the hollow of the cushion in generally horizontal disposition; a thin film heating element is positioned on the substrate member; and means are provided which are operative to transmit electrical energy from a location outside of the cushion to terminals of the thin film heating element. This basic arrangement provides a simple, efficient, waterproof, and durable heating construction for an outdoor seat.

According to further feature of the invention, the seat further includes expanded foam filling the hollow of the cushion in the region beneath the substrate member. The expanded foam serves to locate and fix the substrate member and further serves to discourage migration of heat downwardly from the heating element so as to concentrate the heat in an upward direction against the seating surface.

According to further feature of the invention, the cushion includes an opening proximate a rear edge of the cushion providing access to the hollow interior of the cushion; the substrate member and the thin film heating element comprise an insert; and the insert passes through the access opening in the rear edge of the cushion to position the thin film heating element in the hollow of the cushion beneath the horizontally extending seating surface. This insert arrangement facilitates the construction and assembly of the seat and preserves the waterproof aspect of the seat.

According to further feature of the invention, the insert further includes a handle member including a head trim portion positioned against an outer face of the rear edge of the seat and a neck portion extending forwardly from the head trim portion, passing through the access opening, and fixedly secured to a rear edge of the substrate member. The handle member thus facilitates the installation of the heating unit into the seat cushion without derogating the waterproof aspect of the seat.

According to a further feature of the invention, the seat cushion defines a rearwardly opening crevice within the hollow of the cushion proximate a front end of the cushion, and a forward edge of the substrate member is positioned in the crevice to define and fix the forward position of the substrate member. This coaction between the forward edge of the substrate member and the internally defined crevice further facilitates the installation of the heating assembly into the seat cushion.

According to a further feature of the invention, the seat back is hollow and a heating arrangement generally corresponding to the heating arrangement in the seat cushion is provided in the seat back.

The invention further provides a unique seating arrangement for a stadium. The seating arrangement of the invention comprises a plurality of seats arranged in rows and each including a seat cushion and a seat back; an elongated power lead extending proximate each row and passing proximate each seat in the row; a heating unit positioned in the seat cushion of each seat; a junction box electrically interposed in the power lead proximate each seat; and a detachable electrical connection proximate each seat detachably interconnecting the heating unit in each seat with the respective junction box. This arrangement provides a simple and effective means of selectively providing heating to a large plurality of seats in a stadium environment. In the disclosed embodiment of the invention, each detachable electrical connection comprises a lead extending from the respective junction box and terminating in an electrical lead plug and an electrical plug positioned in a rear edge of the respective seat cushion and sized to detachably receive the lead plug.

The invention further provides a method of providing a heated seat. According to the invention method, a seat cushion is formed as a hollow closed structure including an opening providing access to the hollow interior of the seat; a heater unit is formed including an electrical resistance element; the heater unit is inserted through the access opening and into the hollow of the seat cushion; and electrical energy is delivered to the electrical resistance element from a source of electrical energy located exteriorly of the seat cushion. This methodology provides a simple and efficient means of constructing a heatable seat cushion especially suitable for outdoor use.

According to the further feature of the invention methodology, the heating unit includes a substrate member and a thin film heating unit secured to an upper face of the substrate member and defining the electrical resistance element; the access opening is provided in a rear edge of the seat cushion; and the heating unit is inserted forwardly through the access opening to position the substrate member within the hollow of the seat cushion and position the thin film heating unit beneath the seating surface of the seat cushion. This specific methodology further facilitates the ready and efficient construction of a heatable seat especially suitable for outdoor use.

According to further feature of the invention, the seat cushion is formed as a plastic article in a blow molding operation and the method further includes delivering expandable foam material into the hollow of the seat beneath the substrate. The expandable foam serves to fix the substrate member and further serves to discourage migration of heat downwardly from the heating unit so as to concentrate the delivery of heat from the heating unit upwardly to the seating surface.

DETAILED DESCRIPTION OF THE PREFERRED EMBODIMENT

Figure 1:
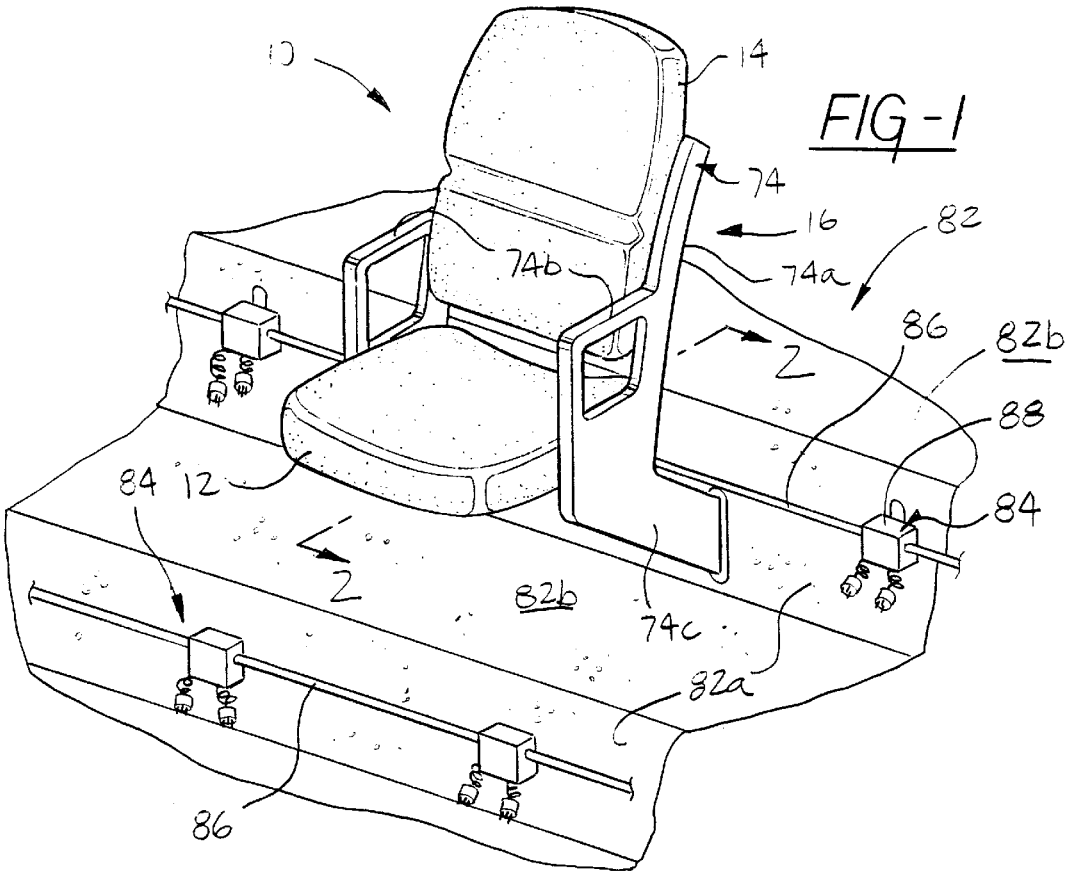
FIG. 1 is a fragmentary perspective view showing the installation of a heated seat assembly according to the invention in a stadium environment.
Figure 5:
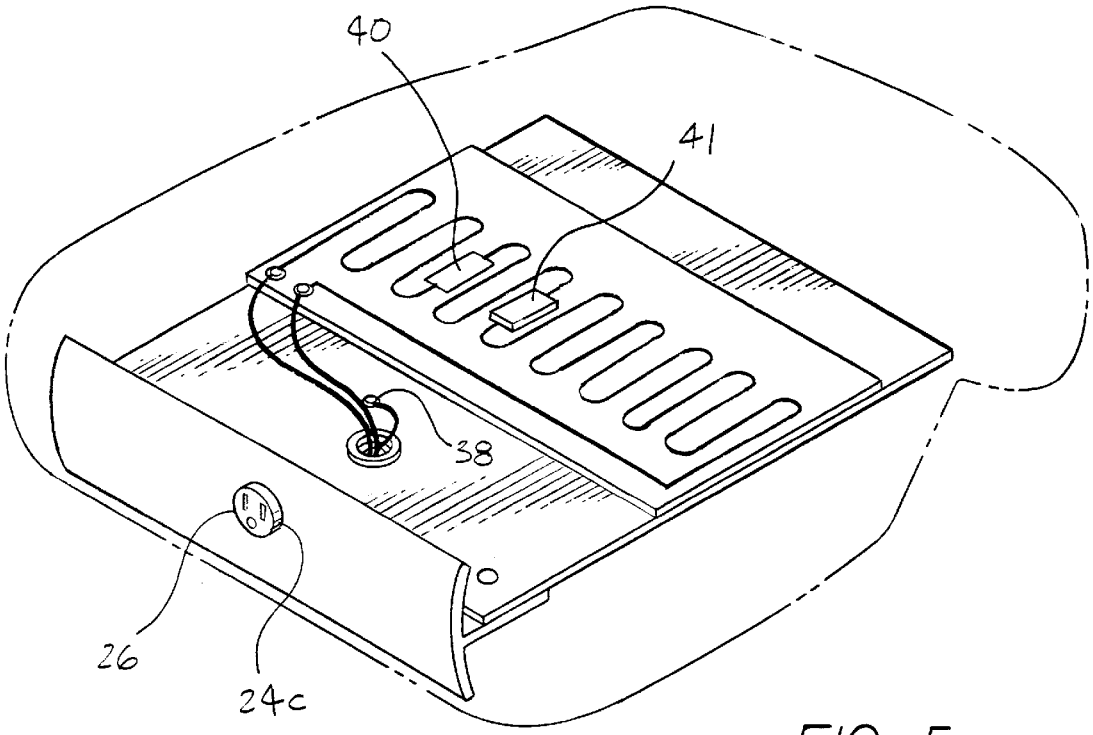
FIG. 5 is a perspective view showing the installation of the heater insert assembly in a seat cushion with the seat cushion shown in phantom.
Figure 2:
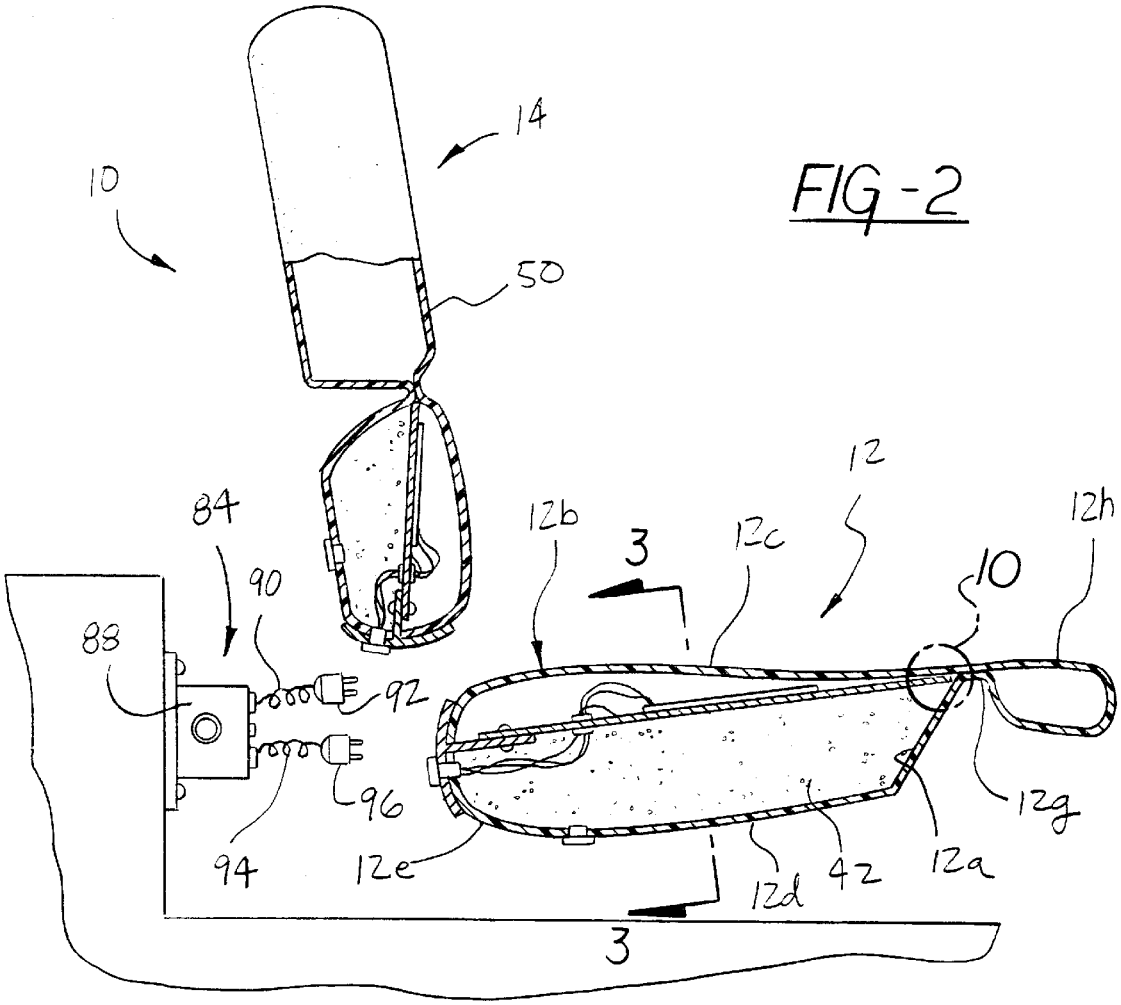
FIG. 2 is a cross-sectional view taken on line 2—2 of FIG. 1.

The heated seat assembly 10 according to the invention includes a seat cushion assembly 11, a seat back assembly 14, and a seat frame 60.

Seat cushion assembly 11 includes a seat cushion 12 formed of a suitable plastic material in a blow molding operation and defining a closed hollow 12*a*. Seat cushion 12 includes an upper wall 12*b* defining a generally horizontally extending seating surface 12*c*; a lower wall 12*d*; and a rear wall 12*e* including an access opening or slot 12*f*. Lower wall 12*d* is kissed off at 12*g* to the confronting lower face of upper wall 12*b* to define the forward boundary of hollow 12*a* and define a front end portion 12*h* of the seat positioned forwardly of the kiss-off point 12*g*.

Seat cushion assembly 11 further includes a heater unit 18 formed as a seat cushion insert. Heater insert 18 includes a substrate board 20; an etched thin film heating element 22; a handle member 24 of T-cross-sectional configuration and including a trim head portion 24*a* and a neck portion 24*b*; an electrical plug 26; and electrical leads 28*a*, 28*b* and 28*c*.

Substrate board 20 may comprise, for example, an aluminum plate.

Figure 9:
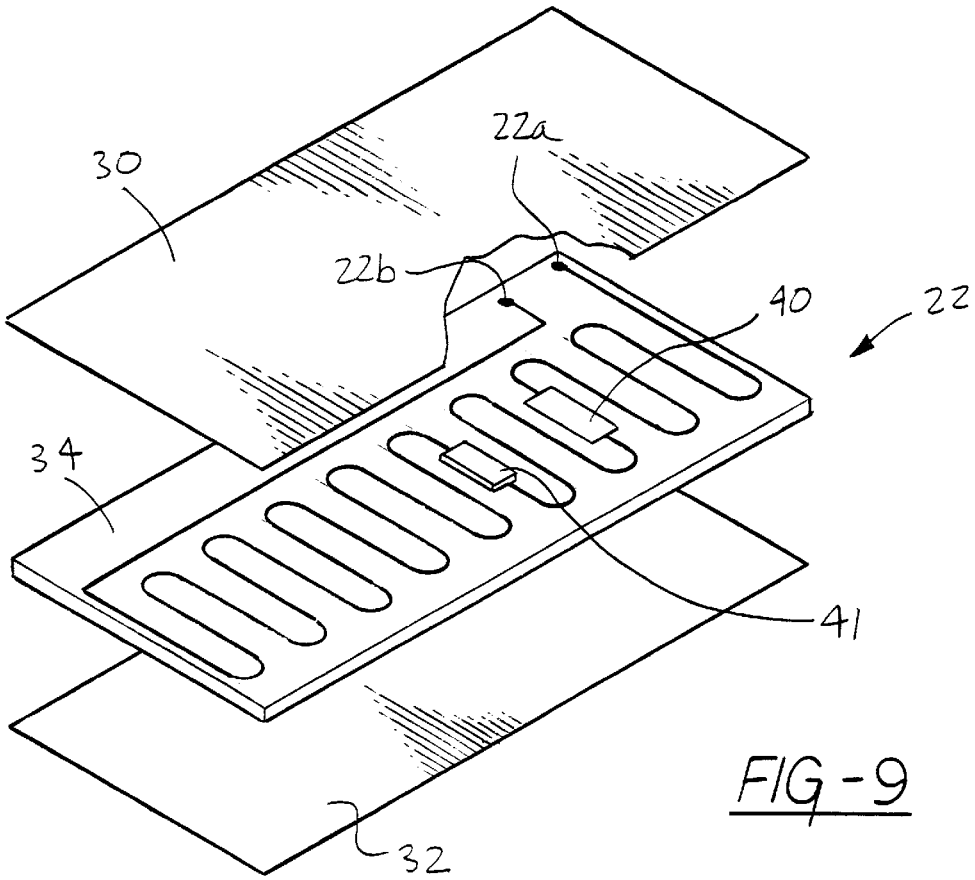
FIG. 9 is an exploded perspective view of a thin film heating element utilized in the heater insert assembly.

Thin film heating element 22, as best seen in FIG. 9, has a sandwich construction including an upper thin layer of moisture impervious insulation material 30, a lower thin layer of moisture impervious insulation material 32, and an etched foil resistive element 34 sandwiched between the moisture impervious insulation layers and totally encapsulated by the moisture impervious layers to form a waterproof construction. Thin film heating elements of this general type are available, for example, from Minco Products, Inc. of Minneapolis, Minn.

In the assembled heater insert 18 a thin film heating element 22 is suitably adhesively secured to the upper face 28*a* of substrate board 20 proximate an intermediate portion 20*b* of the board; a rear edge portion 20*c* of the board is fixedly secured by mechanical fasteners 35 to the upper face of neck portion 24*b* of handle member 24; electrical plug 26 is positioned in a central aperture 24*c* in the head trim portion 24*a* of the handle member; leads 28*a* and 28*b* extend rearwardly from plug 26 beneath neck portion 24*b* and then pass upwardly through a grommet 36 in substrate board 20 for respective connection to the terminals 22*a*, 22*b* of thin film heating element 22; and lead 28*c* passes rearwardly from plug 26 and is suitably grounded to substrate board 20*a*.

The resistive etched wire 22*c* of the thin film heating element extends in sinusoidal fashion through the heating element between terminals 22*a* and 22*b* and the thin film heating element further includes a thermostat 40 and a fuse 41 arranged in series with wire 22*c* and encapsulated in waterproof manner within moisture impervious layers 30 and 32. Thermostat 40 may be set to turn on and off between a range of 120 and 130° F. so that the resistive heating element is maintained at a temperature between 120° and 130° F. and fuse 41 may be set to burn out at 150° F. so that the temperature of the resistive heating element will never rise above 150° F. even if the thermostat fails at its upper end. Insert 18 is inserted through access slot 12f in the rear edge 12*e* of the cushion whereafter the insert is moved forwardly to pass substrate 20 totally through the slot and into the hollow 12*a* of the cushion, pass the neck portion 24*b* of the handle member 24 through the slot, position the leading edge 20*d* of the substrate member in the crevice 140 defined at the kiss-off point 12*g* between the upper and lower walls 12*b* and 12*d* of the cushion, position the forward face 24*d* of the head trim portion 24*a* of the handle member in conforming abutment with the confronting surface of the rear edge portion 12*e* of the seat cushion, and position plug 26 in a central semi-circular cutout 12*i* forming a downward extension of access slot 12*f*. Head trim portion 24*a* is adhesively secured to the rear edge 12*e* of the seat cushion and may if necessary be temporarily mechanically secured to allow the adhesive to set up. The adhesive is waterproof to define a waterproof seal at the interface of the head trim portion 24*a* and seat rear edge 12*e* to preserve the waterproof intensity of the seat.

Figure 3:
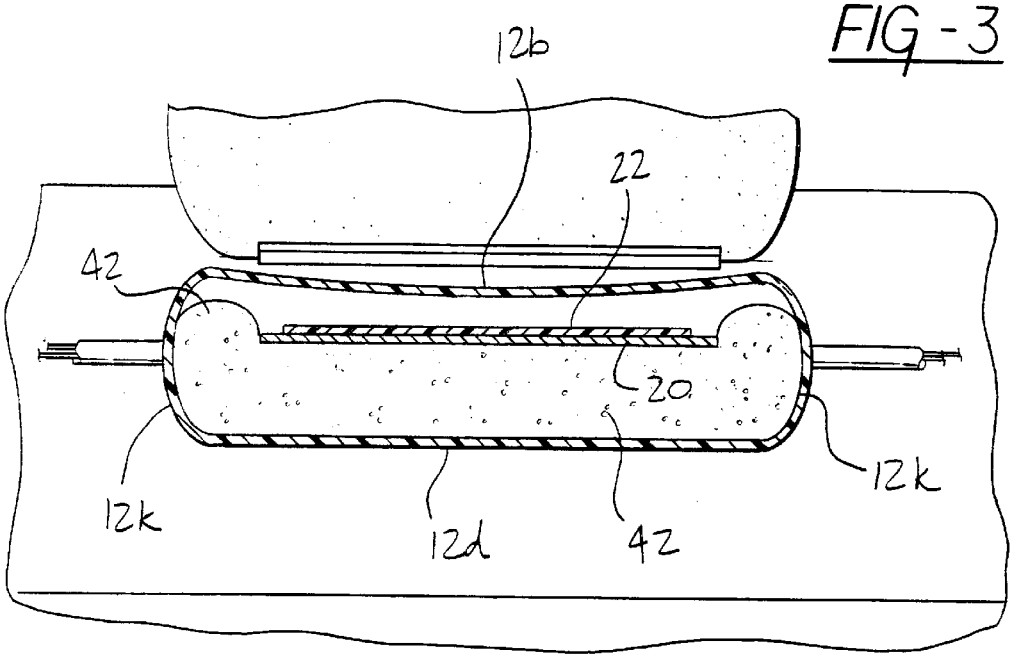
FIG. 3 is a cross-sectional view taken on line 3—3 of FIG. 2.
Figure 4:
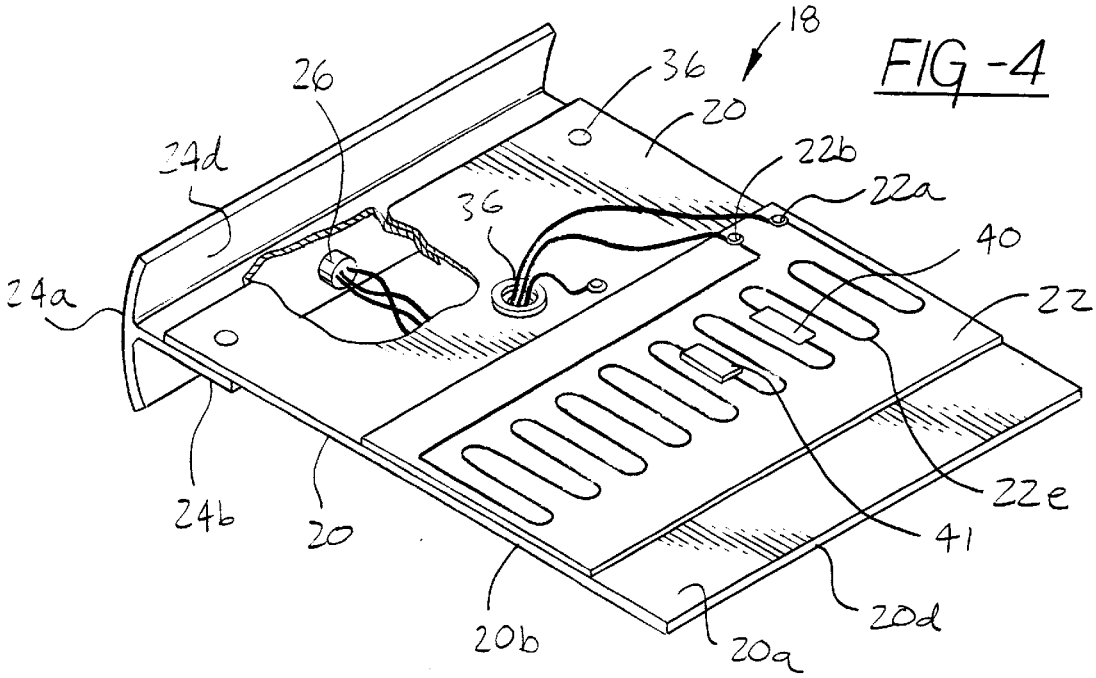
FIG. 4 is a perspective view of a heater insert assembly utilized in the invention seat assembly.
Figure 6:
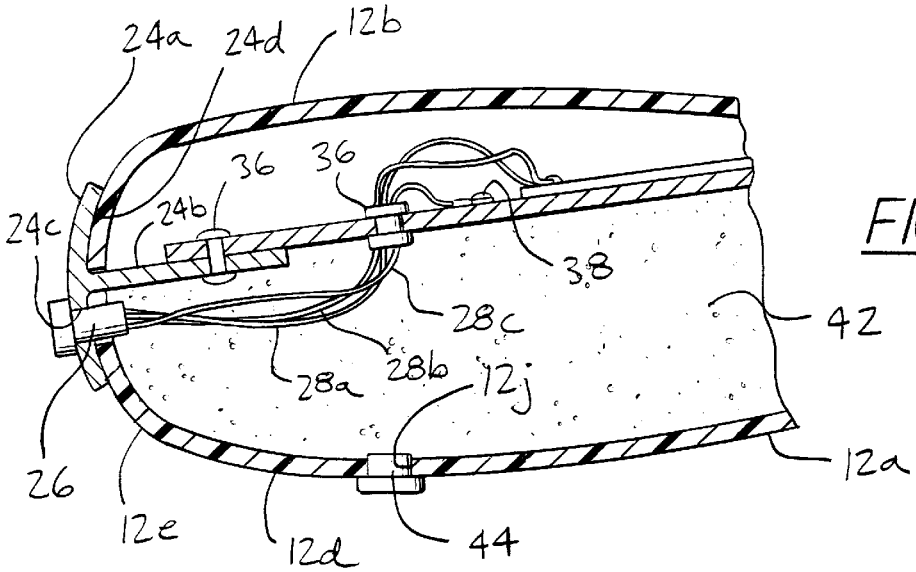
FIG. 6 is a fragmentary cross-sectional view showing details of the mounting of the heater insert assembly in a seat cushion.
Figure 7:
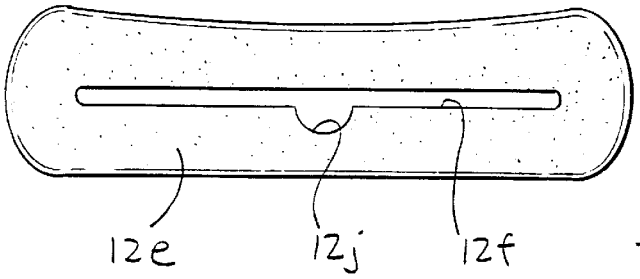
FIG. 7 is an end view of a seat cushion.

After the insert 18 has been inserted as described into the seat cushion, expandable foam 42 is delivered into the hollow 12*a* beneath substrate member 20 via a fill hole 12*j* in the lower wall 12*d* of the cushion and allowed to expand in known manner to fill the hollow 12*a* beneath the substrate member. The expanded foam 42 may also, as seen in FIG. 3, extend upwardly somewhat beyond the level of the substrate member 20 along opposite edges of the substrate. Note in this regard that substrate 20 may be sized so as not to extend the full width between the side walls 12*k* of the cushion so as to leave room as shown for the expanded foam to bulge upwardly along the opposite sides of the substrate member. The fill hole 12*i* is plugged with a suitable sealed plug 24. The expanded foam serves to position and fix substrate member 20 within the hollow of the seat cushion and further serves as heat insulation material to discourage downward migration of heat generated by heating element 22 and concentrate the heat upwardly against seating surface 12*c*. Expandable foam 42 may, for example, comprise a water blown urethane foam which is blown under pressure into the hollow of the cushion in liquid form as a mixture of urethane foam material and reactant chemicals, whereafter the chemicals react to form bubbles which expand the foam to fill the hollow 12*a* beneath the substrate member.

Figure 11:
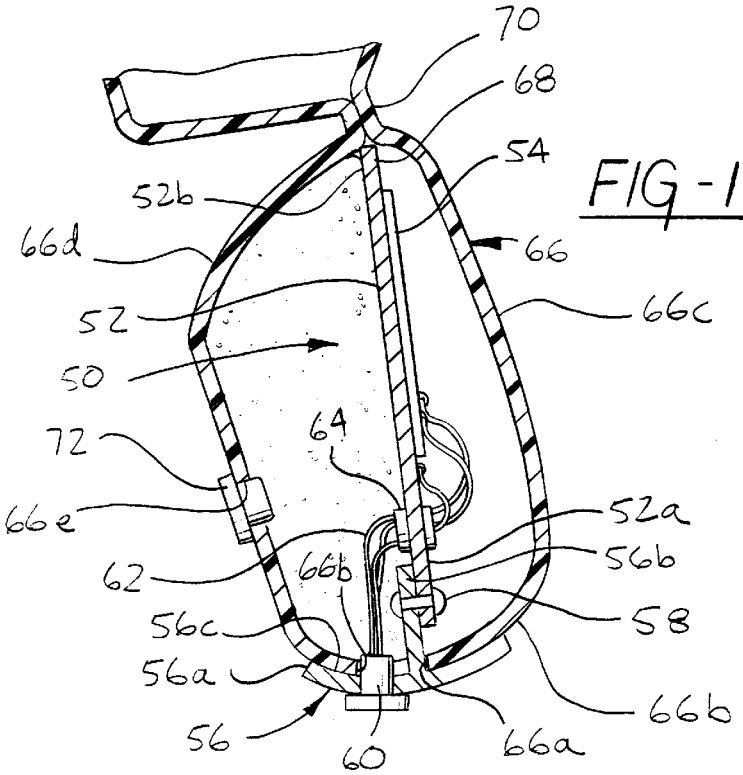
FIG. 11 is a fragmentary cross sectional view showing details of the mounting of a heater insert assembly in a seat back.

Seat back assembly 14 is formed in a manner similar to the described manner of construction of the seat cushion assembly. Specifically, and as best seen in FIG. 11, a heating unit insert 50 is formed including a substrate member 52; a thin film heating element 54 corresponding to thin film heating element 22; a handle member 56 including a head trim portion 56*a* and a neck portion 56*b* mechanically secured as by fasteners 58 to the lower edge 52*a* of the substrate member; an electrical plug 60 positioned in head trim portion 56*a*; and a plurality of leads 62 extending upwardly from the plug and passing through a grommet 64 in the substrate member for suitable grounding on the substrate member and connection to the respective terminals of the thin film heating element 54. Heating unit insert 50 is inserted upwardly through an access slot 66*a* in the bottom edge 66*b* of the hollow blow molded seat back 66 to position the upper edge 52*b* of the substrate member in the crevice 68 defined at the kiss-off 70 of the front and rear walls 66*b* and 66*c* of the seat back with the upper face 56*c* of the end trim portion 56*a* of the handle member cemented to the confronting face of the lower edge 66*b* of the seat back and plug 60 seated in a semi-circular cutout 66*b* formed as an extension of access slot 66*a*. Expandable foam is thereafter delivered through a fill hole 66*e* in the rear wall 66*c* of the seat back to fill the hollow of the seat back rearwardly of substrate member 52 whereafter the fill hole 62*e* is plugged by a suitable plug 72. It will be understood that seat back assembly 14 has a waterproof construction corresponding to the waterproof construction of seat cushion assembly 11.

Seat frame 16 is formed of a suitable metallic material and includes spaced left and right frame members 74 each including an upright portion 74*a*, an arm rest portion 74*b*, and a mounting portion 74*c*. In the completed seat assembly 10, the seat back assembly 14 is fixedly mounted between spaced uprights 74*a*, the seat cushion assembly is pivotally secured to the spaced arm rest portions 74*b*, and the mounting portions 74*c* are utilized to mount the seat assembly in the chosen seat environment.

Figure 8:
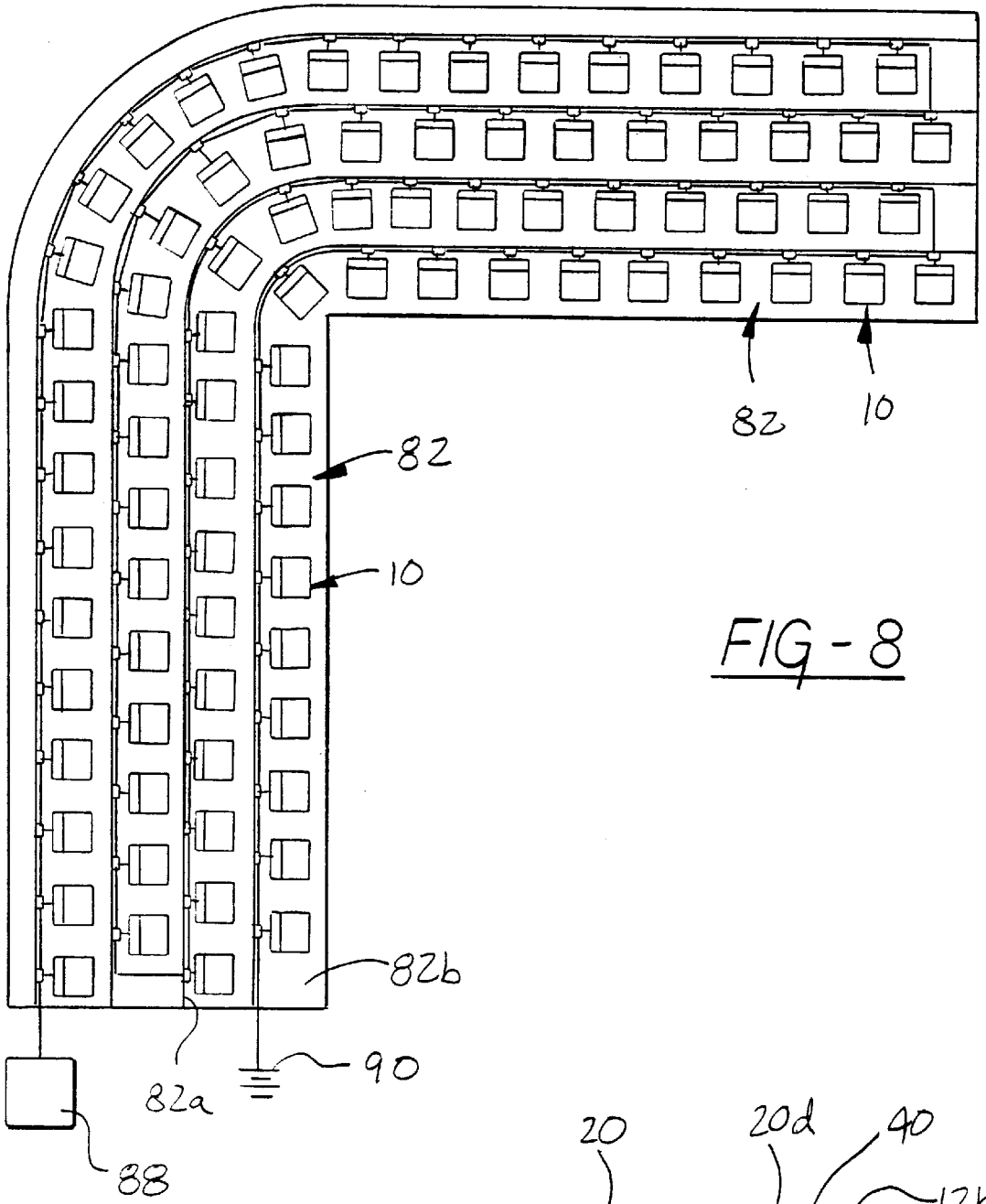
FIG. 8 is a plan view showing a plurality of heated seat assemblies according to the invention arranged in a stadium environment.
Figure 10:
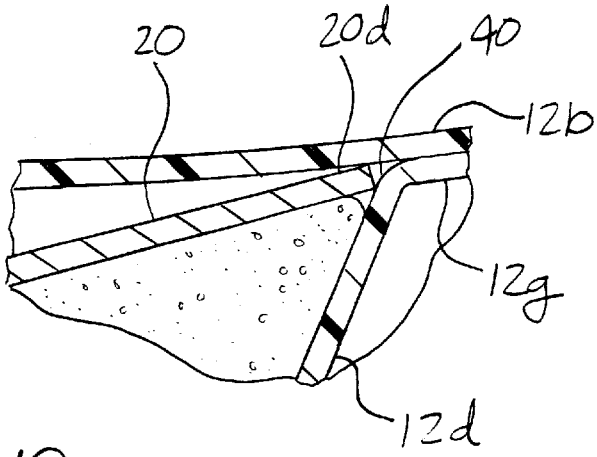
FIG. 10 is a detailed view taken within the circle 10 of FIG. 2.

Seat assembly 10, by virtue of its rugged and waterproof construction, is especially suitable for use in an outdoor environment such as a stadium 80 as seen in FIG. 8. Specifically, a plurality of seat assemblies 10 are arranged in rows in the stadium with the frame mounting portions 74*a* of the seat frames secured to vertical riser surfaces 82*a* of a bleacher or grand stand 82 of the stadium and seat cushions 12 extending outwardly over horizontal run surfaces 82*b* of the bleacher or grand stand.

A junction box 84 is positioned against riser surface 82*a* immediately behind each seat assembly and an electrical power cord or lead 86 extends along each riser face and electrically interconnects the successive junction boxes so that the junction boxes are electrically interposed in the power lead 86.

Each junction box includes a box 88, a pigtail cord 90 terminating in a plug 92, a pigtail cord 94 terminating in a plug 96, and a switch 98.

In the installed configuration of the seat assembly in a stadium, plug 92 is suitably inserted into plug 60 of the seat back assembly to provide electrical energy to the thin film heating element 54 of the seat back assembly and plug 90 is suitably connected to the plug 26 of the seat cushion assembly to provide electrical energy to the thin film heating element 22 of the seat cushion assembly. Power is selectively delivered to pigtail cords 90 and 94 from central power lead 86 by switch 98. As seen in FIG. 8, a single lead 86 may extend in serpentine fashion through the entire stadium environment between a source 88 of electrical energy and a ground 90, or a plurality of individual leads 86 may selectively supply individual rows of seats in the stadium. In either arrangement, it will be seen that power to all of the seats can be selectively controlled from the power source 88 and power to individual seats can be selectively controlled by the individual switch 98 in the individual junction box associated with the seat. The seat assembly may operate on 115 VAC line power or any other chosen power level.

The heated seat assembly will be seen to have many important advantages. Specifically, the assembly has a rugged, simple, and waterproof construction that lends itself to the harsh environments of an outdoor stadium. Further, the seat assembly lends itself to a low cost modular construction where the seat assembly inserts are manufactured and tested using mass production techniques and then inserted into the seat cushions. Further, the invention seat assembly is very efficient in its energy usage because of the inherent efficiency of the thin film heating elements employed and further by virtue of the action of the expanded foam positioned respectively beneath and behind the heater inserts and acting to preclude downward and rearward migration of heat generated at the inserts to concentrate the heat upwardly and forwardly against the respective seating surfaces. Further, the invention seat assembly lends itself to large scale stadium installations wherein a junction box may be readily provided in association with each seat cushion and each seat back and readily electrically connected to the cushion and back for heating as required.

Whereas a preferred embodiment of the invention has been illustrated and described in detail it will be apparent that various changes may be made in the disclosed embodiment without departing from the scope or spirit of the invention.

What is claimed is:

1. A heated seat assembly comprising:

a hollow seat cushion including an upper wall defining a generally horizontally extending seating surfaces, further walls coacting with the upper wall to define a closed hollow beneath the upper wall, and an access opening in one of said walls providing access to the closed hollow;

a heater insert including a substrate structure passing through the access opening and positioned within the closed hollow in generally horizontal disposition and a thin film heating element positioned on the substrate structure and having terminals; and means operative to transmit electrical energy from a location outside of the cushion to the terminals of the thin film heating element.

2. A heated seat assembly according to claim 1 wherein the seat further includes expanded foam filling the closed hollow in a region beneath the substrate member.

3. A heated seat assembly according to claim 2 wherein:

the substrate structure includes a plate member; and the thin film heating element is secured to an upper face of the plate member.

4. A heated seat assembly according to claim 2 wherein the seat assembly further includes a hollow seat back extending upwardly from a rear edge of the seat cushion, a thin film heating element positioned in a hollow of the seat back, and means operative to transmit electrical energy from a location outside of the seat back to terminals of the seat back thin film heating element.

5. A heated seat assembly according to claim 4 wherein the seat assembly further includes expanded foam filling the hollow of the seat back in a region behind the thin film heating element.

6. A heated seat assembly according to claim 1 wherein:

the access opening is provided in a rear edge of the cushion.

7. A heated seat assembly according to claim 1 wherein:

another of said further walls engages said upper wall to form a crevice, one end of said heater insert engages said one of said further walls, and an opposite end of said heater insert is engaged in said crevice.

8. A heated seat assembly comprising:

a hollow seat cushion defining a generally horizontally extending seating surface;

a substrate positioned within the hollow of the cushion in generally horizontal disposition;

a thin film heating element positioned on the substrate member and having terminals; and means operative to transmit electrical energy from a location outside of the cushion to the terminals of the thin film heating element;

the cushion including an access opening proximate a rear edge of the cushion providing access to the hollow interior of the cushion;

the substrate member and the thin film heating element comprising an insert passing through the access opening to position the thin film heating element in the hollow of the cushion beneath the horizontally extending seating surface;

the insert further including a handle member including a head trim portion positioned against an outer face of the rear edge of the seat and a neck portion extending forwardly from the head trim portion, passing through the access opening, and fixedly secured to a rear edge of the substrate member.

9. A heated seat assembly according to claim 8 wherein:

the seat cushion defines a rearwardly opening crevice within the hollow of the cushion proximate a front end of the cushion; and a forward edge of the substrate member is positioned in the crevice to define and fix a forward position of the substrate member.

10. The heated seat assembly according to claim 9 wherein the seat further includes expanded foam filling the hollow of the cushion in a region beneath the substrate member.

* * * * *